US005635327A

United States Patent [19]

Fukuda et al.

[11] Patent Number: 5,635,327

[45] Date of Patent: Jun. 3, 1997

[54] ELECTROPHOTOGRAPHIC PHOTORECEPTOR AND PROCESS FOR PREPARING THE SAME

[75] Inventors: Yuzuru Fukuda; Shigeru Yagi; Taketoshi Higashi, all of Ashigara, Japan

[73] Assignee: Fuji Xerox Co., Ltd., Tokyo, Japan

[21] Appl. No.: 448,989

[22] Filed: May 24, 1995

Related U.S. Application Data

[62] Division of Ser. No. 172,914, Dec. 27, 1993, Pat. No. 5,447,812.

[30] Foreign Application Priority Data

Dec. 28, 1992 [JP] Japan ..... 4-358782

[51] Int. Cl.[6] ..... G03G 5/147

[52] U.S. Cl. ..... 430/128; 430/132

[58] Field of Search ..... 430/128, 132

[56] References Cited

U.S. PATENT DOCUMENTS 4,426,435 1/1984 Oka ..... 430/132

4,895,783 1/1990 Lee et al. ..... 430/66

FOREIGN PATENT DOCUMENTS 58-121044 7/1983 Japan ..... 430/66

62-273556 11/1987 Japan ..... 430/66

1-219754 9/1989 Japan ..... 430/66

4-88350 3/1992 Japan .

*Primary Examiner*—Roland Martin

*Attorney, Agent, or Firm*—Oliff & Berridge

[57] ABSTRACT

An electrophotographic photoreceptor and process for preparing the same, the photoreceptor comprising a conductive substrate having thereon a photoconductive layer and a surface layer in this order, the photoconductive layer comprising amorphous silicon containing at least one of hydrogen and a halogen, and the surface layer comprising a dried and/or cured product under a reduced pressure of an inorganic or organic high molecular weight material containing fine particles of a conductive metal oxide dispersed therein.

8 Claims, 3 Drawing Sheets

ELECTROPHOTOGRAPHIC PHOTORECEPTOR AND PROCESS FOR PREPARING THE SAME

This is a division of application No. 08/172,914 filed Dec. 27, 1993, now U.S. Pat. No. 5,447,812.

FIELD OF THE INVENTION

This invention relates to an electrophotographic photoreceptor, and more particularly to an electrophotographic photoreceptor having a photoconductive layer comprising amorphous silicon. It also relates to a process for preparing the same.

BACKGROUND OF THE INVENTION

Electrophotography is an image forming method wherein a photoreceptor is electrostatically charged with and imagewise exposed to light to form an electrostatic latent image, the electrostatic latent image is then developed with a developer, and the resulting toner image is transferred onto a transfer paper and fixed to obtain an image. The photoreceptor for use in electrophotography basically comprises a photoconductive layer formed on a conductive substrate. Amorphous silicon (hydrogenated amorphous silicon) has been used as the material for the photoconductive layer in recent years, and many improvements have been attempted. Amorphous silicon photoreceptors using amorphous silicon are prepared by forming an amorphous layer of silicon on a conductive substrate, for example, by discharge decomposition of silane ($SiH_4$) gas. Hydrogen atom is introduced into the amorphous silicon layer to thereby impart good photoconductivity. The amorphous silicon photoreceptors have such characteristics that the photosensitive layer has a high surface hardness, excellent wear resistance, excellent heat resistance, excellent electrical stability, a wide range of spectral sensitivity, and high photosensitivity. Accordingly, the amorphous silicon photoreceptors have suitable properties as the electrophotographic photoreceptors as described above.

However, the amorphous silicon photoreceptors have a disadvantage in that dark resistance is relatively low, and hence the dark attenuation of the photoconductive layer is large, and a sufficient charging potential can not be obtained when the photoreceptors are charged, though the amorphous silicon photoreceptors have excellent characteristics as the photoreceptors. Namely, the amorphous silicon photoreceptors have a disadvantage in that when the amorphous silicon photoreceptors are charged and imagewise exposed to light to form an electrostatic latent image and the electrostatic latent image is developed, surface charges on the photoreceptors are attenuated until imagewise exposure to light, or charges in the unexposed area are attenuated until development, and hence a charging potential required for development can hardly be obtained.

The attenuation of the charging potential is apt to be affected by environmental conditions, and the charging potential is greatly lowered particularly under high temperature and humidity conditions. Further, when the photoreceptors are repeatedly used, the charging potential is gradually lowered. When the electrophotographic photoreceptors that exhibit the large dark attenuation of the charging potential are used to obtain images, the image density becomes low and the reproducibility of half tone becomes poor.

Attempts have been made in which a surface layer of amorphous silicon carbide, amorphous silicon nitride, or amorphous silicon oxide is formed on the photoconductive layer comprising amorphous silicon by plasma CVD process to improve the above-described disadvantage.

However, when the amorphous silicon photoreceptors having such a surface layer as described above are repeatedly used to obtain images, faint images occur. This phenomenon is remarkable particularly under high humidity conditions, and such photoreceptors can not be used in practical electrophotographic processes.

Further, the amorphous silicon layers prepared by plasma CVD process have disadvantages in that the amorphous silicon layers are apt to the cracked and have poor impact resistance in comparison with selenium photoconductive layers and organic photoconductive layers, though the amorphous silicon layers have a high surface hardness. Accordingly, the photoreceptors mainly composed of amorphous silicon are liable to be marred by paper releasing grippers, etc. in duplicators or printers. As a result, white spots or black spots are liable to be formed in resulting images.

Furthermore, the amorphous silicon photoreceptors have many defects having a semispherical form of 1 to 80 μm in diameter on the surface of the photoconductive layer, and when image formation is repeatedly conducted, electrical and mechanical breakage occurs in the defected parts of the layer, and white spots and black spots appear on the image by breakage of the layer, whereby the image quality is damaged.

The present inventors have made studies and found that when the photoreceptors have the amorphous layer mainly composed of silicon, nitrogen or carbon formed by the plasma CVD process on the surface thereof, the photoreceptors are thermally and mechanically stable, and further they are photoelectrically stable in the electrophotographic process, but they are unstable against oxidation in comparison with other materials, and oxide films formed on the surface thereof are more active than layers of organic and inorganic high molecular weight materials against moisture and the adsorption of corotron products. The present inventors have found that breakage of the defected parts of the layer can be prevented not by concentrating an ion stream from corotron into the flaw parts of the layer, but by dispersing the ion stream from corotron without concentrating an ion stream into the defected parts, which breakage has been conventionally considered to be a factor by which the life of the amorphous silicon photoreceptors is limited. The present inventors have previously proposed an electrophotographic photoreceptor having a surface layer of an organic or inorganic high molecular weight material containing fine particles of a conductive oxide dispersed therein, as described in JP-A-4-88350 (the term "JP-A" as used herein means an "unexamined published Japanese patent application").

However, the present inventors have found that the aforesaid electrophotographic photoreceptor has still a disadvantage in that when an image formation process is repeatedly conducted to obtain many copies of as much as 300,000 copies or more, faint images occur, and the photoreceptor is marred by paper releasing finger made of iron. The present invention is intended to overcome the above-noted problems associated with the prior art.

SUMMARY OF THE INVENTION

An object of the present invention is to provide an amorphous silicon photoreceptor that scarcely suffers from dark attenuation of the charging potential.

Another object of the present invention is to provide an amorphous silicon photoreceptor that has excellent mechanical strength, does not produce any defect on the resulting image and has a long life.

Still another object of the present invention is to provide an amorphous silicon photoreceptor that does not cause faint images, has excellent long-term stability and can be applied to conventional electrophotographic process.

Still a further object of the present invention is to provide an electrophotographic photoreceptor that can form images having less moire even when applied to laser printers using a coherent light source.

Other objects and effects of the present invention will be apparent from the following description.

The present invention relates to an electrophotographic photoreceptor comprising a conductive substrate having thereon a photoconductive layer and a surface layer in this order, the photoconductive layer comprising amorphous silicon containing at least one of a hydrogen and halogen, and the surface layer comprising a dried and/or cured product under a reduced pressure of an inorganic or organic high molecular weight material containing fine particles of a conductive metal oxide dispersed therein.

In another preferred embodiment, the electrophotographic photoreceptor of the present invention may be provided with an interlayer between the photoconductive layer and the surface layer. The interlayer may comprise at least one layer comprising amorphous silicon carbide, amorphous silicon nitride, amorphous silicon oxide, or amorphous carbon.

The present invention also relates to a process for preparing an electrophotographic photoreceptor, which process comprises the steps of: forming a photoconductive layer comprising amorphous silicon containing at least one of hydrogen and a halogen on a conductive substrate by glow discharge decomposition; coating the surface of the photoconductive layer with an inorganic or organic high molecular weight material containing fine particles of a conductive metal oxide dispersed therein; and drying and/or curing the coating under a reduced pressure to form a surface layer.

In a preferred embodiment, an interlayer, which may comprise at least one layer comprising amorphous silicon carbide, amorphous silicon nitride, amorphous silicon oxide, or amorphous carbon, is formed on the photoconductive layer by glow discharge decomposition, and the surface layer is formed on the interlayer.

DETAILED DESCRIPTION OF THE INVENTION

Figure 1:
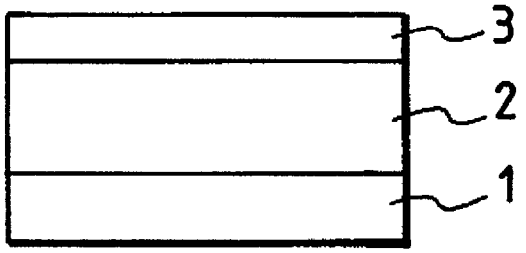
FIG. 1 is a schematic sectional view showing one embodiment of the layer structure of an electrophotographic photoreceptor according to the present invention.
Figure 2:
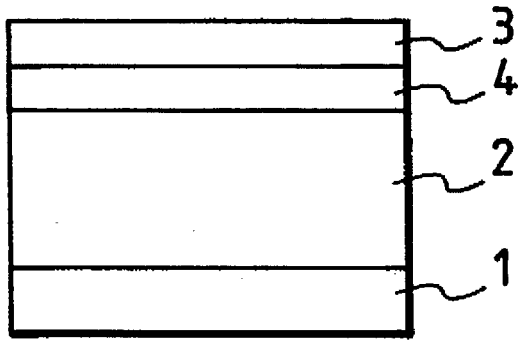
FIG. 2 is a schematic sectional view showing another embodiment of the layer structure of an electrophotographic photoreceptor according to the present invention.
Figure 3:
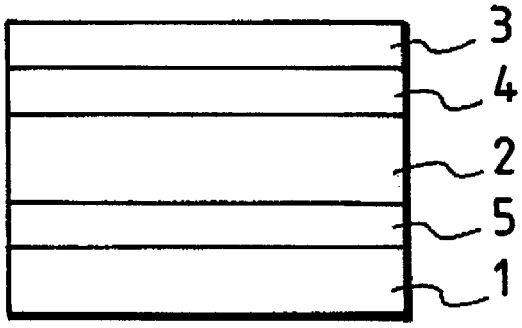
FIG. 3 is a schematic sectional view showing still another embodiment of the layer structure of an electrophotographic photoreceptor according to the present invention.

The electrophotographic photoreceptor of the present invention may have layer structures shown in FIGS. 1 to 3. In an embodiment shown in FIG. 1, photoconductive layer 2 comprising amorphous silicon is provided on conductive substrate 1, and surface layer 3 comprising an organic or inorganic high molecular weight material containing fine particles of a conductive metal oxide dispersed therein is formed on photoconductive layer 2. In an embodiment shown in FIG. 2, interlayer 4 is further provided between photoconductive layer 2 and surface layer 3. In an embodiment shown in FIG. 3, charge injection prevention layer 5 is still further provided between conductive substrate 1 and photoconductive layer 2.

Any conventional conductive supports and insulating supports may be used as the conductive substrate used in the present invention. Examples of the conductive supports include substrates composed of metals such as aluminum, nickel, chromium and stainless steel; alloys of these metals; and intermetallic compounds such as $In_2O_3$, $SnO_2$, CuI and $CrO_2$.

Examples of the insulating supports include films and sheets composed of high molecular weight materials such as polyesters, polyethylene, polycarbonates, polystyrenes, polyamides and polyimides; glass; and ceramics. When an insulating support is used, at least the surface, on which a photoconductive layer is provided, is treated to make the surface electrically conductive. The treatment for making the surface electrically conductive can be made by depositing metals such as gold, silver, copper and the above-described metals on the surface by means of vacuum deposition, sputtering or ion plating.

A photoconductive layer comprising amorphous silicon is provided on the conductive substrate. The photoconductive layer can be formed on the conductive substrate by means of glow discharge, sputtering, ion plating or vacuum deposition process. According to a process where silane ($SiH_4$) gas is decomposed by glow discharge of plasma CVD process (glow discharge process) in particular, a photoconductive layer can be obtained that contains an appropriate amount of hydrogen and has a relatively high dark resistance and a high photoconductivity. Hydrogen gas may be introduced into the plasma CVD device together with silane gas to thereby incorporate more effectively hydrogen in the photoconductive layer.

Examples of raw material gases which can be used to provide amorphous silicon of the photoconductive layer include silane gas ($SiH_4$), hydrogenated silicon compounds such as $Si_2H_6$, $Si_3H_8$ and $Si_4H_{10}$, and other silicon compounds such as $SiCl_4$, $SiF_4$, $SiHF_3$, $SiH_2F_2$ and $SiH_3F$.

The photoconductive layer comprising amorphous silicon may further contain other elements. For example, Group III or V elements such as an impurity element of boron (B) or phosphorus (P) may be added to the photoconductive layer to control the dark resistance of the amorphous silicon photoconductive layer or to control the charging polarity thereof. Examples of raw material gases which can be used to incorporate Group III or V elements in the photoconductive layer include $B_2H_{67}$, $B_4H_{10}$, $BF_3$, $BCl_3$, $PH_3$, $P_2H_4$, $PF_3$ and $PCl_3$.

The amorphous silicon photoconductive layer may contain a halogen atom, oxygen atom, nitrogen atom, etc. to increase the dark resistance of the layer, the photosensitivity thereof, and the chargeability (chargeability or charging potential per unit layer thickness) thereof.

Further, germanium may be added to the photoconductive layer to increase sensitivity in the long wavelength region. Examples of raw material gases which can be used to incorporate germanium in the photoconductive layer include $GeH_4$, $Ge_2H_6$, $Ge_3H_8$, $Ge_4H_{10}$, $Ge_5H_{12}$, $GeF_4$, and $GeCl_4$.

The above elements other than hydrogen can be contained in the amorphous silicon photoconductive layer by introducing the gasified raw materials containing these elements together with silane gas as the principal raw material into the plasma CVD device, and carrying out glow discharge decomposition.

Glow discharge decomposition for forming the photoconductive layer comprising amorphous silicon by using the above-described raw material gases can be carried out under such conditions that, for example, when discharge is conducted by alternating current, frequency of power source is generally from 0.1 to 30 MHz, preferably from 5 to 20 MHz, the degree of vacuum during discharge is generally from 0.1 to 5 Torr (13.3 to 667 Pa), and the heating temperature of the substrate is generally from 100° to 400° C.

The thickness of the photoconductive layer comprising amorphous silicon may be optionally selected, and is generally from 1 to 200 μm, preferably from 10 to 100 μm.

An interlayer may be provided between the photoconductive layer and a surface layer. The interlayer reduces the influence of the surface oxidation of the surface layer and prevents the charge injection from the surface layer.

The interlayer may comprise at least one layer comprising amorphous silicon carbide, amorphous silicon nitride, amorphous silicon oxide, or amorphous carbon, which may contain hydrogen. It is preferred from the standpoint of adhesion and productivity that the interlayer is formed by plasma CVD process.

When the interlayer-comprising silicon is prepared, silanes and higher silanes can be used as raw materials for silicon. Specific examples thereof include $SiH_4$, $Si_2H_6$, $SiCl_4$, $SiHCl_3$, $SiH_2Cl_2$, $Si(CH_3)_4$, $Si_3H_8$ and $Si_4H_{10}$.

Examples of raw materials of carbon for amorphous silicon carbide or amorphous carbon include aliphatic hydrocarbons such as paraffinic hydrocarbons of formula $C_nH_{2n+2}$ such as methane, ethane, propane, butane and pentane; olefinic hydrocarbons of formula $C_nH_{2n}$ such as ethylene, propylene, butylene and pentene; acetylenic hydrocarbons of formula $C_nH_{2n-2}$ such as acetylene, allylene and butyne; alicyclic hydrocarbons such as cyclopropane, cyclobutane, cyclopentane, cyclohexane, cycloheptane, cyclobutene, cyclopentene and cyclohexene; and aromatic hydrocarbons such as benzene, toluene, xylene, naphthalene and anthracene.

These hydrocarbons may be substituted by halogen. Specific examples of the halogen-substituted hydrocarbons include carbon tetrachloride, chloroform, carbon tetrafluoride, trifluoromethane, chlorotrifluoromethane, dichlorofluoromethane, bromotrifuoromethane, fluoroethane and perfluoropropane.

Examples of raw materials of nitrogen for amorphous silicon nitride include gaseous materials and gasifiable compounds such as nitrogen gas, gasifiable nitrides and gasifiable azides. Specific examples of these raw materials include nitrogen gas ($N_2$), ammonia ($NH_3$), hydrazine ($H_2NNH_2$), hydrogen azide ($NH_3$) and ammonium azide ($NH_4N_3$).

Examples of raw materials of oxygen for amorphous silicon oxide include oxygen ($O_2$), ozone ($O_3$), carbon monoxide (CO), carbon dioxide ($CO_2$), nitrogen monoxide (NO), nitrogen dioxide ($NO_2$), dinitrogen trioxide ($N_2O_3$), dinitrogen tetraoxide ($N_2O_4$), dinitrogen pentaoxide ($N_2O_5$), nitrogen trioxide ($NO_3$), tetramethoxysilane ($Si(OCH_3)_4$) and tetraethoxysilane ($Si(OC_2H_5)_4$).

While the above-described raw materials may be gas, solid or liquid at ordinary temperature, they are gasified and introduced into the reaction chamber when the raw materials are solid or liquid.

The interlayer may be composed of a single layer or a laminated layer formed by laminating plural layers containing different elements onto each other. The element distribution in the interlayer may be uniform or non-uniform. When the element distribution is non-uniform, the change of the element distribution may be discontinuous or continuous.

The interlayer can be formed by plasma CVD process under such conditions that, for example, when alternating current discharge is conducted, frequency is generally from 0.1 to 30 MHz, preferably from 5 to 20 MHz, the degree of vacuum during discharge is generally from 0.1 to 5 Torr (13.3 to 667 Pa), and the heating temperature of the substrate is generally from 100° to 400° C.

The thickness of the interlayer is generally from 0.05 to 10 μm, preferably from 0.1 to 50 μm. When the thickness is less than 0.05 μm, charge injection prevention properties are poor, while when the thickness is 5 μm or more, residual potential is high, and a lowering in sensitivity occurs.

The surface layer of the electrophotographic photoreceptor of the present invention functions as a charge blocking layer for preventing charge from being introduced from the surface of the photoconductive layer into the interior thereof during charging. The surface layer also functions as a surface protective layer for preventing the surface of the photoconductive layer from being brought into direct contact with oxidizing molecules such as oxygen, steam, moisture in air, ozone, etc. generally present in an environmental atmosphere, and for preventing the oxidizing molecules from being deposited on the photoconductive layer. The surface layer further functions as a surface protective layer for preventing the characteristics of the photoconductive layer itself from being deteriorated by external factors, for example, the application of stress, the deposition of reactive chemical materials, etc.

In addition, the surface layer functions as an atom release preventing layer for preventing atoms such as hydrogen contained in the photoconductive layer from being released from the photoconductive layer.

The electrophotographic photoreceptor of the present invention is applied to the Carlson process wherein charging and imagewise exposure to light are conducted. Accordingly, it is necessary that the surface layer is made low-insulating to thereby prevent charge from being accumulated on the surface of the surface layer or in the interior thereof. However, when conductivity is too high, charge migrates in the crosswise direction, and faint images occurs. When the conductivity is too low, charge is accumulated and as a result, the image is fogged. Accordingly, the conductivity of the surface layer must be properly controlled, and the conductivity must be stable against external factors such as temperature, humidity, etc. Further, the surface layer must have a sufficient mechanical strength to use the photoreceptor in the Carlson process. Furthermore, materials which are added to the surface layer to make the surface layer low-insulating must be those which neither color the surface layer nor have an adverse effect on the spectral sensitivity of the photoreceptor.

To meet the above requirements, the surface layer of the present invention may be formed on the photoconductive layer or the interlayer by coating a composition of an inorganic or organic high molecular weight material as a binder resin containing fine particles of a conductive metal oxide dispersed therein or by preparing a film from the composition and adhering the film.

The fine particles of the conductive metal oxide to be dispersed in the surface layer preferably has an average particle size of preferably 0.3 μm or smaller, particularly preferably from 0.05 to 0.3 μm. If the particle size is larger than the wavelength of the light to which the photoreceptor is exposed, the transparency of the surface layer tends to be deteriorated. Therefore, it is preferred that 90% by weight of the particles have a particle size of 0.3 μm, and more preferably 95% by weight of the particles have a particle size of 0.3 μm.

Examples of the fine particles of the conductive metal oxide include zinc oxide, titanium oxide, tin oxide, antimony oxide, indium oxide, bismuth oxide, tin-doped indium oxide, antimony-doped tin oxide, and zirconium oxide. Fine particles of these metal oxides may be used either alone or as a mixture of two or more of them. When a mixture of two or more metal oxides is used, the mixture may be used in the form of a solid solution or a fused material. Among the above conductive oxides, tin oxide is preferably used which may be a solid solution of SnO and $SnO_2$ or tin oxide doped with a small amount of metals such as antimony.

Any of electrically active high molecular weight materials such as polyvinyl carbazole and electrically inactive high molecular weight materials can be used as the organic high molecular weight materials to be used as the binder resins in the surface layer of the present invention. Examples of the organic high molecular weight materials include polyvinyl carbazole, acrylic resins, polycarbonate resins, polyester resins, vinyl chloride resins, fluororesins, polyurethane resins, epoxy resins, unsaturated polyester resins, polyamide resins, and polyimide resins. Of these resins, curable resins (thermosetting resins) are preferred from the standpoint of mechanical strength and adhesion.

The organic high molecular weight material as the binder resin and the conductive metal oxide fine particles are dissolved or dispersed in a solvent. The viscosity of the resulting composition is adjusted and coated on the photoconductive layer or the interlayer by means of spray coating or dip coating. Subsequently, the coated composition is dried and/or cured under a reduced pressure. Drying and/or curing under a reduced pressure may be carried out under heating.

Silicone resins and inorganic high molecular weight compounds formed from organometallic compounds can be used as the inorganic high molecular weight materials.

When liquid silicone resins are used as the inorganic high molecular weight materials, fine particles of the conductive metal oxide is dispersed in the resins, and the resulting dispersion is coated and then dried and/or cured under a reduced pressure. Drying and/or curing may be carried out under heating.

The surface layer can be formed by a sol-gel method in the following manner:

Alkoxide compounds such as $Si(OCH_3)_4$, $Si(OC_2H_5)_4$, $Si(OC_3H_7)_4$, $Si(OC_4H_9)_4$, $Al(OCH_3)_3$, $Al(OC_2H_5)_3$, $Al(OC_4H_9)_3$, $Ti(OC_3H_7)_4$, $Zr(OC_3H_7)_4$, $Y(OC_3H_7)_3$, $Y(OC_4H_9)_3$, $Fe(OC_2H_5)_3$, $Fe(OC_3H_7)_3$, $Fe(OC_4H_9)_3$, $Nb(OCH_3)_5$, $Nb(OC_2H_5)_5$, $Nb(OC_3H_7)_5$, $Ta(OC_3H_7)_5$, $Ta(OC_4H_9)_4$, $Ta(OC_3H_7)_4$, $V(OC_2H_5)_3$ and $V(OC_4H_9)_3$; or organic metal complexes such as iron tris(acetylacetonato), cobalt bis(acetylacetonato), nickel bis(acetylacetonato) and copper bis(acetylacetonato) are dissolved in an alcohol and hydrolyzed with stirring. Fine particles of a conductive metal oxide are dispersed in the sol solution formed by the hydrolyzing reaction, and the resulting dispersion is coated on the photoconductive layer or the interlayer by means of spray coating or dip coating. After the solvent is removed, the coated layer is dried with heating under a reduced pressure.

Among the above organic or inorganic high molecular weight materials, polyurethane resins and silicon oxide are preferred. Isocyanate group-containing compounds can be used as a curing agent for the polyurethane resins. Silicon oxide is formed from hydrolyzable compounds such as silicon alkoxide through hydrolyzing reaction with an alcohol which serves as a curing agent and a solvent. The hydrolyzable compounds are cured by hydrolyzing the compounds and removing the solvent.

The drying of the surface layer under a reduced pressure or the drying and/or curing treatment under a reduced pressure in the present invention can be carried out by conventional methods, for example, by using a vacuum heating apparatus or a vacuum drying apparatus.

The drying and/or curing treatment employed in the present invention is described below.

A composition containing a film forming material (the above-mentioned high molecular weight materials and metallic or non-metallic alkoxides), a solvent and, if used, a curing agent can be dried by removing the solvent from the composition. The film forming material is cured by drying. Upon removing the solvent, chemical reactions (curing reactions), e.g., condensation or addition reactions, may occur within the film forming material and/or between the film forming material and a curing agent. In the present invention, such curing reactions may or may not occur.

The composition may be heated upon removal of the solvent and the curing reaction. The heating temperature is generally selected such that the functional layers, e.g., a photoconductive layer, provided before the formation of a surface layer are not adversely affected by heating. The heating temperature is generally from 10° to 250° C., and preferably from 20° to 200° C.

The drying and/or curing treatment may be conducted by one step operation and is preferably conducted in two or more steps in which the coated layer is first dried to the touch and then subjected to dried and/or curing treatment under a reduced pressure. In the latter case, the drying to the touch may be conducted in the air under normal pressure. That is, it is particularly preferred that the coated composition is first dried to the touch in the air and then dried and/or cured under a reduced pressure. Upon drying to the touch, the coated composition may be heated to 10° to 70° C., and preferably from 20° to 60° C.

In the case where a thermoplastic resin is used as a binder resin, the resin may be dissolved in a solvent. The resulting solution is coated, and the solvent is then removed to cure the thermoplastic resin. In the case where a thermosetting resin is used as a binder resin, the resin may be dissolved in a solvent along with a curing agent if used. The resulting solution is coated, and the solvent is then removed. At the same time, a curing reaction occurred by heat, for example, and the surface layer is thus cured. In the case where a silicone resin is used as a binder resin, it can be dried and/or cured in the same manner as in the case of the thermoplastic resin. In the case where an organic metallic or non-metallic compound is used as a binder, organic metallic or non-metallic compounds having a hydrolyzable group such as an alkoxy group and a chlorine atom are preferably used. The organic metallic or non-metallic compounds are generally dissolved in an alcoholic solvent to be hydrolyzed, and the alcoholic solvent is then removed to be cured. By removing the alcoholic solvent, the central metallic atoms of the compound are linked to each other via an oxygen atom to form an oxide matrix.

The layer comprising of a dried and/or cured material obtained under a reduced pressure has high transparency in comparison with the layer formed by conventional method such as curing with drying or curing with heating in the air. When the layer of the present invention is formed under optimized conditions, the visible light transmission can be as high as 90% or more. Further, the abrasion resistance and corona resistance of the layer can be increased to provide a layer which has excellent optical, mechanical and chemical characteristics and has the optimum characteristics as the surface layer of the electrophotographic photoreceptor.

The cross section of the layer was observed through a transmission electron microscope, and it was found that the layer formed by curing with drying or curing with heating in the air in conventional method had many pores or voids in the layer, while the layer formed by drying and/or curing with heating under a reduced pressure according to the present invention did not have such pores or voids. This shows that the surface layer of the electrophotographic photoreceptor of the present invention is a very dense film having neither pore nor void in contrast with the conventional surface layer formed by curing in the air. Accordingly, it is considered that the electrophotographic photoreceptor of the present invention has improved abrasion resistance and improved corona resistance.

The pressure in the drying and/or curing treatment of the surface layer under a reduced pressure in the present invention is preferably $5.05\times10^4$ Pa (0.5 atm) or below, more preferably $1.01\times10^4$ Pa (0.1 atm) or below. When the pressure is higher than that described above, pores or voids are left behind in the film formed, and abrasion resistance and corona resistance become poor.

The thickness of the surface layer may be optionally selected, and is generally 20 μm or less, preferably from 0.1 to 10 μm. When the thickness exceeds 20 μm, residual potential after exposure to light tends to be high, while when the thickness is smaller than 0.1 μm, mechanical strength tends to be poor and the characteristics of the amorphous silicon photoreceptor may not be sufficiently displayed.

If desired, a charge injection prevention layer may be provided on the conductive substrate of the electrophotographic photoreceptor of the present invention. As the charge injection prevention layer, p-type amorphous silicon heavy-doped with a Group III element, n-type amorphous silicon heavy-doped with a Group V element, or an insulating thin film of SiN=, $SiO_x$ or $SiC_x$ can be used. These insulating thin film can be formed in the same manner as in the formation of the interlayer. The thickness of the charge injection prevention layer is preferably from 0.3 to 10 μm.

The invention is further illustrated by means of the following examples and comparative examples, but the invention is not construed as being limited to the examples.

EXAMPLE 1

A capacity coupling type plasma CVD device capable of preparing an amorphous silicon layer on a cylindrical substrate was used, and a mixture of silane ($SiH_4$) gas, hydrogen (Hz) gas and diborane ($B_2H_6$) gas was subjected to glow discharge decomposition, thereby forming a charge injection prevention layer of about 2 μm in thickness on a cylindrical aluminum substrate. The preparation of the charge injection prevention layer was carried out under the following conditions:

100% Silane Gas Flow Rate: 150 $cm^3$/min
100 ppm Hydrogen-diluted
Diborane Gas Flow Rate: 300 $cm^3$/min
Internal Pressure of Reactor: 0.6 Torr
Discharge Power: 100 W
Discharge Frequency: 13.56 MHz
Temperature of Substrate: 250° C.

In all of the following examples and comparative examples, the above discharge frequency and the above substrate temperature were used in the preparation of each layer by the plasma CVD process.

After the preparation of the charge injection prevention layer, the reactor was thoroughly evacuated. A mixture of silane gas, hydrogen gas and diborane gas was then introduced into the reactor, and subjected to glow discharge decomposition, thereby forming a photoconductive layer of about 20 μm in thickness on the charge injection prevention layer. The preparation of the photoconductive layer was carried out under the following conditions:

100% Silane Gas Flow Rate: 150 $cm^3$/min
100% Hydrogen Gas Flow Rate: 145 $cm^3$/min
100 ppm Hydrogen-diluted Diborane Gas Flow Rate: 2 $cm^3$/min
Internal Pressure of Reactor: 1.0 Torr
Discharge Power: 300 W After the preparation of the photoconductive layer, the reactor was thoroughly evacuated. A mixture of silane gas, hydrogen gas and ammonia gas was then introduced into the reactor and subjected to glow discharge decomposition, thereby forming the first interlayer of about 0.3 μm in thickness on the photoconductive layer. The preparation of the first interlayer was carried out under the following conditions:

100% Silane Gas Flow Rate: 50 $cm^3$/min
100% Hydrogen Gas Flow Rate: 200 $cm^3$/min
100% Ammonia Gas Flow Rate: 50 $cm^3$/min
Internal Pressure of Reactor: 0.5 Torr
Discharge Power: 50 W After the preparation of the first interlayer, the reactor was thoroughly evacuated. A mixture of silane gas, hydrogen gas and ammonia gas was then introduced into the reactor and subjected to glow discharge decomposition, thereby forming the second interlayer of about 0.1 μm in thickness on the first interlayer. The preparation of the second interlayer was carried out under the following conditions:

100% Silane Gas Flow Rate: 30 $cm^3$/min
100% Hydrogen Gas Flow Rate: 200 $cm^3$/min
100% Ammonia Gas Flow Rate: 70 $cm^3$/min
Internal Pressure of Reactor: 0.5 Tort
Discharge Power: 50 W Subsequently, a surface layer comprising an organic high molecular material containing fine particles of a conductive metal oxide having an average particle size of not larger than 0.3 μm dispersed therein was provided on the second interlayer.

The preparation of the surface layer was carried in the following manner:

| | |
|---|---|
| Tin Oxide/Antimony Oxide (15%) Conductive Particles | 16 parts by weight |
| Polyurethane Resin (Rethane Clear, a product of Kansai Paint Co., Ltd.) | 68 parts by weight |
| Solvent (Rethane thinner, a product of Kansai Paint Co., Ltd.) | 16 parts by weight |

The above ingredients were mixed and dispersed in a ball mill for 45 hours, and 8 parts by weight of an isocyanate compound as a curing agent (Rethane curing agent, a product of Kansai Paint Co., Ltd.) was added thereto. The resulting solution was coated on the second interlayer by means of spray coating. After drying to the touch, the coat was dried and cured at 130° C. under a reduced pressure of 10 Torr (1,330 Pa) or below in a vacuum heating apparatus for 15 hours, thereby obtaining the surface layer of 3 μm in thickness.

The cross section of the surface layer was observed, and it was found that the particles were composed of 70% of particles having a particle size of not larger than 0.1 μm, 25% of particles having a particle size of 0.1 to 0.3 μm and 5% of particles having a particle size of not smaller than 0.3 μm. Any pore or void was not found in the surface layer.

The thus prepared electrophotographic photoreceptor was tested to evaluate image quality. The test was conducted by using a copying machine (FX5990, a product of Fuji Xerox Co., Ltd.). The copying machine was set under three environmental conditions of 30° C./85% RH, 20° C./50% RH and 10° C./15% RH.

The resulting copies after initial run as well as after 20,000 runs were free from faint images under the above three environmental conditions. Further, 400,000 copies were made under environmental conditions of 30° C./85% RH, neither faint images nor fog were found. Furthermore, copying was conducted without exposure to light, and the resulting copied images had no image defect.

The electrophotographic photoreceptor was applied to semiconductor laser printer (XP-9, a product of Fuji Xerox Co., Ltd.), and printing was conducted. Images of high quality which had no moire fringe were obtained.

COMPARATIVE EXAMPLE 1

An electrophotographic photoreceptor was prepared in the same manner as in Example 1 except that the formation of the surface layer comprising the organic high molecular weight material containing the fine particles of conductive metal oxide dispersed therein was not made under a reduced pressure, but the surface layer was formed in the air.

The thus prepared electrophotographic photoreceptor was tested to evaluate image quality in the same manner as in Example 1. The resulting copies after initial run as well as after 20,000 runs were free from faint images under the three environmental conditions in Example 1. However, faint images occurred when 400,000 copies were made under environmental conditions of 30° C./85% RH. Further, copying was conducted without exposure to light to obtain a full solid image, and it was found that the resulting copied image had white lines formed by the paper releasing finger made of iron.

EXAMPLE 2

The charge injection prevention layer and the photoconductive layer were formed in the same manner as in Example 1. An interlayer of 0.4 μm in thickness, comprising amorphous silicon carbide was formed under the following conditions in place of the first and second interlayer of Example 1:

100% Silane Gas Flow Rate: 50 $cm^3$/min
100% Ethylene Gas Flow Rate: 250 $cm^3$/min
Hydrogen Gas Flow Rate: 150 $cm^3$/min
Internal Pressure of Reactor: 0.5 Torr
Discharge Power: 250 W Subsequently, a surface layer having the same composition as that of Example 1 was formed under a reduced pressure on the interlayer in the same manner as in Example 1. The thickness of the surface layer was 6 μm.

The thus prepared electrophotographic photoreceptor was tested to evaluate image quality in the same manner as in Example 1. The resulting copies after initial run as well as after 20,000 runs were free from faint images under the three environmental conditions in Example 1. Further, 400,000 copies were made under environmental conditions of 30° C./85% RH. Neither faint images nor fog occurred. Furthermore, copying was conducted without exposure to light to obtain a full solid image, and it was found that the resulting copied images had no image defect.

COMPARATIVE EXAMPLE 2

An electrophotographic photoreceptor was prepared in the same manner as in Example 2 except that the surface layer was formed not under a reduced pressure, but in the air.

The resulting electrophotographic photoreceptor was tested to evaluate image quality in the same manner as in Example 2. The resulting copies after initial run as well as after 20,000 runs were free from faint images. However, faint images occurred when 400,000 copies were made under environmental conditions of 30° C./85% RH. Further, copying was conducted without exposure to light to obtain a full solid image, and it was found that copied images had white lines formed by the paper release gripper made of iron.

EXAMPLE 3

An electrophotographic photoreceptor mainly composed of amorphous silicon was prepared in the same manner as in Example 1 except that a surface layer comprising an inorganic high molecular weight material containing fine particles of conductive metal oxide having an average particle size of not larger than 0.3 μm was formed under the same reduced pressure as in Example 1 in place of the surface layer of Example 1.

The surface layer was formed in the following manner:

| | |
|---|---|
| Silicon alkoxide capable of forming $SiO_2$ (Ceramica G-90, a product of Nippan Kenkyusho K.K.) | 55 parts by weight |
| Tin Oxide/Antimony Oxide Conductive Particles | 10 parts by weight |

The above ingredients were mixed and dispersed in a ball mill for 100 hours, and an alcohol curing agent was added thereto. The resulting coating composition was coated on the second interlayer comprising amorphous silicon nitride by means of dip coating. After drying to the touch, the coat was dried at 150° C. under a reduced pressure of 10 Torr (1,330 Pa) or below for 15 hours, thereby forming a surface layer of 3 μm in thickness. The surface layer was analyzed by XPS, and no element was detected except silicon oxide, tin oxide, and antimony oxide.

The resulting electrophotographic photoreceptor was tested to evaluate image quality in the same manner as in Example 1. The copies after initial run as well as after 20,000 runs were free from faint images under the three environmental conditions in Example 1. Further, 350,000 copies were made under environmental conditions of 30° C./85% RH. Neither faint images nor fog were found. Furthermore, copying was conducted without exposure to light to obtain a full solid image, and it was found that copied images had no image defect.

COMPARATIVE EXAMPLE 3

An electrophotographic photoreceptor was prepared in the same manner as in Example 3 except that the surface layer was formed not under a reduced pressure, but in the air.

The electrophotographic photoreceptor was tested to evaluate image quality in the same manner as in Example 3.

The copies after initial run as well as after 20,000 runs were free from faint images. However, faint images occurred when 350,000 copies were made under environmental conditions of 30° C./85% RH. Further, copying was conducted without-exposure to light to obtain a full solid image, and it was found that the copied images had white lines formed by paper releasing gripper made of iron.

EXAMPLE 4

An electrophotographic photoreceptor comprising amorphous silicon was prepared in the same manner as in Example 1 under the same conditions as those of Example 1 except that a surface layer comprising an inorganic high molecular weight material containing fine particles of conductive metal oxide having an average particle size of 0.3 μm was formed in place of the surface layer of Example 1.

The surface layer was formed in the following manner:

| | |
|---|---|
| Silicone X-41-9710H (a product of Shin-Etsu Chemical Industry Co., Ltd.) for protective coating | 55 parts by weight |
| Tin Oxide/Antimony Oxide (15%) Conductive Particles | 10 parts by weight |

The above ingredients were mixed with a solvent (e.g., N-methyl-2-pyrrolidone, methyl cellosolve and dimethylformamide) and dispersed for 50 hours, while the mixture was kept at a temperature of 10° C. The dispersion was coated by means of spray coating on the second interlayer. After drying to the touch, the coat was cured with drying at 180° C. under a reduced pressure of 10 Torr (1,330 Pa) or below for 15 hours, thereby forming the surface layer of 1 μm in thickness.

The electrophotographic photoreceptor was tested to evaluate image quality in the same manner as in Example 1. The resulting copies after initial run as well as after 20,000 runs were free from faint images under the three environmental conditions in Example 1. Further, even after 400,000 copies were made, faint images were not found. Furthermore, abrasion caused by the paper releasing gripper made of iron was not found.

COMPARATIVE EXAMPLE 4

An electrophotographic photoreceptor was prepared in the same manner as in Example 4 except that the surface layer was formed not under a reduced pressure, but in the air.

The electrophotographic photoreceptor was tested to evaluate image quality in the same manner as in Example 4. The resulting copies after initial run as well as after 20,000 runs were free from faint images. However, faint images occurred when 400,000 copies were made under environmental conditions of 30° C./85% RH. Further, copying was conducted without exposure to light to obtain a full solid image, and the resulting copied images had white lines formed by the paper releasing gripper made of iron.

Figure 4:
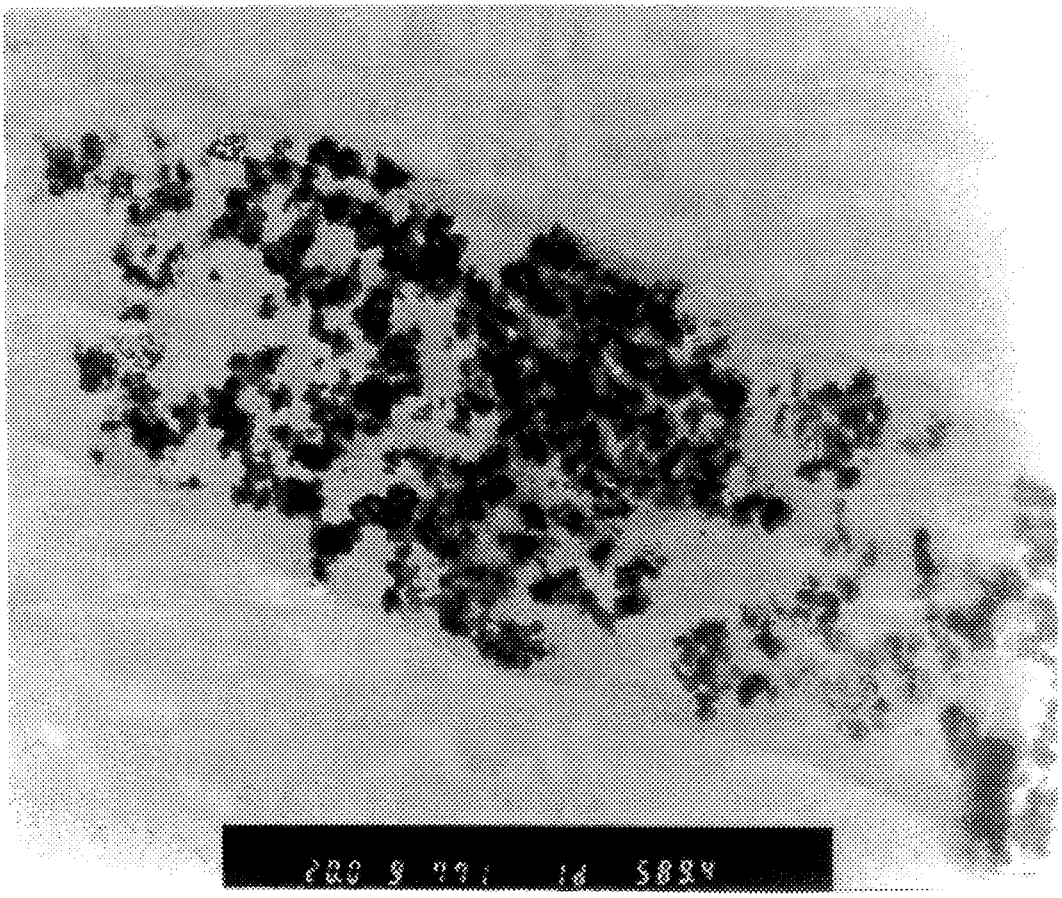
FIG. 4 is a electron micrograph (magnification: 30,000) showing a cross section of a surface layer of an electrophotographic photoreceptor prepared in Example 4.
Figure 5:
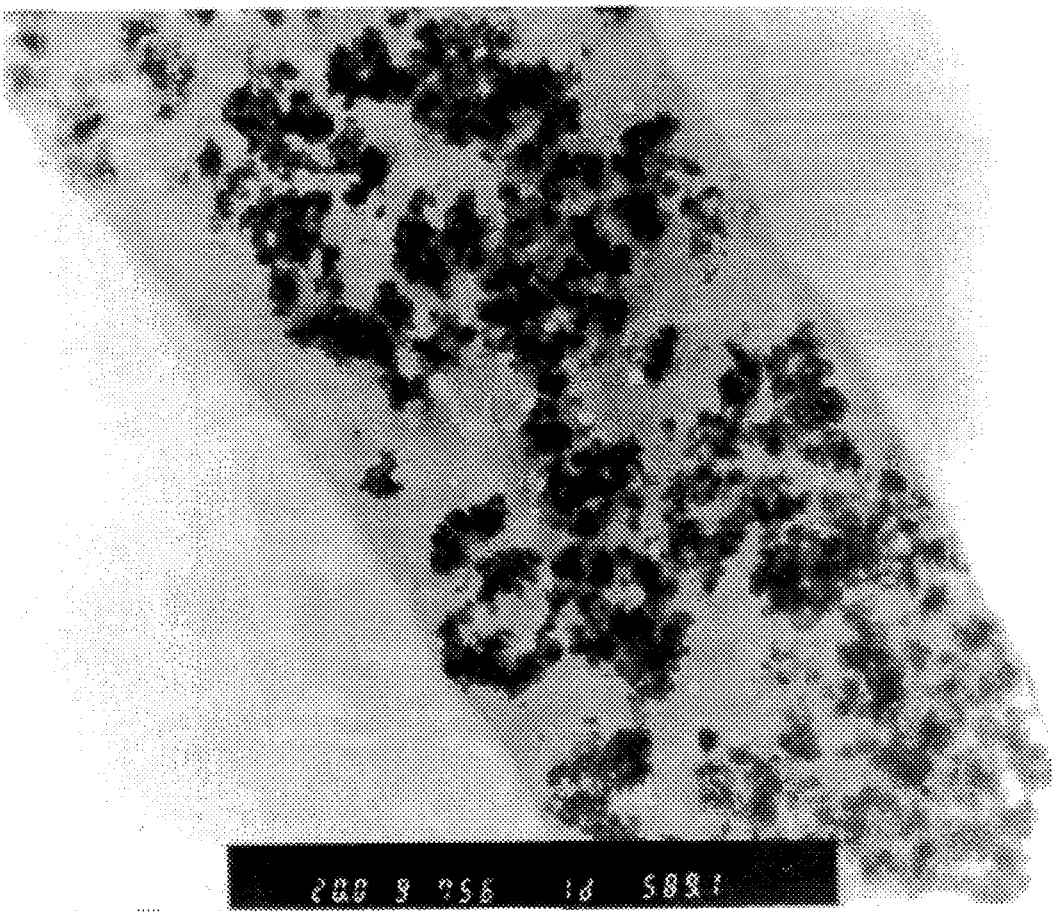
FIG. 5 is a electron micrograph (magnification: 30,000) showing a cross section of a surface layer of an electrophotographic photoreceptor prepared in Comparative Example 4.

The cross sections of the surface layers of the photoreceptors obtained in Example 4 and Comparative Example 4 were observed with a scanning electron microscope. The resulting electron micrographs (magnification: 30,000) are shown in FIGS. 4 and 5 respectively. In the surface layer of Comparative Example 4 (FIG. 5), many pores or voids were formed in the surface layer, which are found in FIG. 5 as white spots.

As described in the foregoing, the surface layer of the electrophotographic photoreceptor of the present invention is formed by drying and/or curing under a reduced pressure or curing with drying or heating under a reduced pressure an organic or inorganic high molecular weight material containing fine particles of conductive metal oxide dispersed therein. Accordingly, the electrophotographic photoreceptor of the present invention has advantages in that faint images do not occur even when an image formation process such as copying is conducted for a long time, the photoreceptor has excellent abrasion resistance and durability, and copied images hardly suffer from image defect, for example, the formation of white lines even when copying is conducted for a long time.

Further, the electrophotographic photoreceptor of the present invention can be applied to laser printers using coherent light such as infrared semiconductor laser as a light source. Images of high quality which prevent the formation of moire fringe in the laser printers can be obtained.

While the present invention has been described in detail and with reference to specific embodiments thereof, it is apparent to one skilled in the art that various changes and modifications can be made therein without departing from the spirit and the scope of the present invention.

What is claimed is:

1. A process for preparing an electrophotographic photoreceptor, which comprises the steps of:

forming a photoconductive layer comprising amorphous silicon containing at least one of hydrogen and a halogen on a conductive substrate by means of glow discharge decomposition;

coating the surface of said photoconductive layer with an inorganic or organic high molecular weight material containing fine particles of a conductive metal oxide dispersed therein; and drying and/or curing the coating under a reduced pressure to form a surface layer free of pores or voids.

2. A process for preparing an electrophotographic photoreceptor as claimed in claim 1, wherein said process comprises the steps of:

forming a photoconductive layer comprising amorphous silicon containing at least one of hydrogen and a halogen on a conductive substrate by means of glow discharge decomposition;

forming an interlayer comprising at least one layer comprising amorphous silicon carbide, amorphous silicon nitride, amorphous silicon oxide, or amorphous carbon on the photoconductive layer by means of glow discharge decomposition;

coating the surface of said interlayer with an inorganic or organic high molecular weight material containing fine particles of a conductive metal oxide dispersed therein; and drying and/or curing the coating under a reduced pressure to form a surface layer free of pores or voids.

3. The process of claim 1, wherein said reduced pressure is $5.05\times10^4$ Pa or below.

4. The process of claim 1, wherein said pressure is $1.01\times10^4$ Pa or below.

5. The process of claim 1, further comprising forming an interlayer on said photoconductive layer by glow discharge decomposition and forming said surface layer on said interlayer.

6. The process of claim 5, wherein said interlayer comprises an amorphous material selected from the group consisting of amorphous silicon carbide, amorphous silicon nitride, amorphous silicon oxide and amorphous carbon.

7. The process of claim 2, wherein said reduced pressure is $5.05\times10^4$ Pa or below.

8. The process of claim 2, wherein said pressure is $1.01\times10^4$ Pa or below.

* * * * *